US012653296B2

(12) United States Patent
Haynie

(10) Patent No.: US 12,653,296 B2
(45) Date of Patent: Jun. 16, 2026

(54) VIBRATING MASCARA WAND WITH INTERCHANGEABLE MASCARA HEADS

(71) Applicant: Julianne Haynie, Ottumwa, IA (US)

(72) Inventor: Julianne Haynie, Ottumwa, IA (US)

( * ) Notice: Subject to any disclaimer, the term of this patent is extended or adjusted under 35 U.S.C. 154(b) by 159 days.

(21) Appl. No.: 18/587,222

(22) Filed: Feb. 26, 2024

(65) Prior Publication Data

US 2025/0268359 A1 Aug. 28, 2025

(51) Int. Cl.

| | |
|---|---|
| ***A45D 34/04*** | (2006.01) |
| ***A46B 5/00*** | (2006.01) |
| ***A46B 9/02*** | (2006.01) |
| ***A46B 13/02*** | (2006.01) |
| ***A46B 15/00*** | (2006.01) |
| ***A46B 17/04*** | (2006.01) |

(52) U.S. Cl.

CPC ..... *A45D 34/042* (2013.01); *A46B 5/0095* (2013.01); *A46B 9/021* (2013.01); *A46B 13/023* (2013.01); *A46B 15/0095* (2013.01); *A46B 17/04* (2013.01); *A45D 2200/207* (2013.01); *A45D 2200/25* (2013.01); *A46B 2200/106* (2013.01)

(58) Field of Classification Search

CPC .... A45D 34/042; A45D 33/26; A46B 5/0095; A46B 9/021; A46B 13/023; A46B 15/0095; A46B 13/02; A46B 2200/1046; A46B 17/04

USPC ..... 132/218

See application file for complete search history.

(56) References Cited

U.S. PATENT DOCUMENTS

| | | | | |
|---|---|---|---|---|
| 2008/0138138 | A1* | 6/2008 | Gueret | A45D 34/04 401/23 |
| 2009/0293905 | A1* | 12/2009 | Albert | A45D 33/28 132/297 |
| 2012/0294666 | A1* | 11/2012 | Jang | A46B 17/04 401/126 |
| 2014/0216489 | A1* | 8/2014 | Knaus | A45D 40/26 132/218 |
| 2014/0341631 | A1* | 11/2014 | Cakridas | A45D 33/008 401/126 |
| 2015/0013713 | A1* | 1/2015 | Palmieri | A45D 40/265 132/218 |
| 2020/0288840 | A1* | 9/2020 | Al-Sulatieen | A45D 42/00 |
| 2021/0120947 | A1* | 4/2021 | Machiorlette | A46B 9/10 |
| 2022/0061513 | A1* | 3/2022 | Jungnickel | A46B 15/0093 |

* cited by examiner

*Primary Examiner* — Edelmira Bosques
*Assistant Examiner* — Holly T. To
(74) *Attorney, Agent, or Firm* — The Iwashko Law Firm, PLLC; Lev Ivan Gabriel Iwashko, Esq.

(57) ABSTRACT

A vibrating mascara wand with interchangeable mascara heads, including a vibrating assembly to provide vibration for the vibrating mascara wand with interchangeable mascara heads, a first detachable mascara head connected to the vibrating assembly to receive the vibration from the vibrating assembly, and a cap assembly to detachably connect to the vibrating assembly and to store the first detachable mascara head therein.

3 Claims, 1 Drawing Sheet

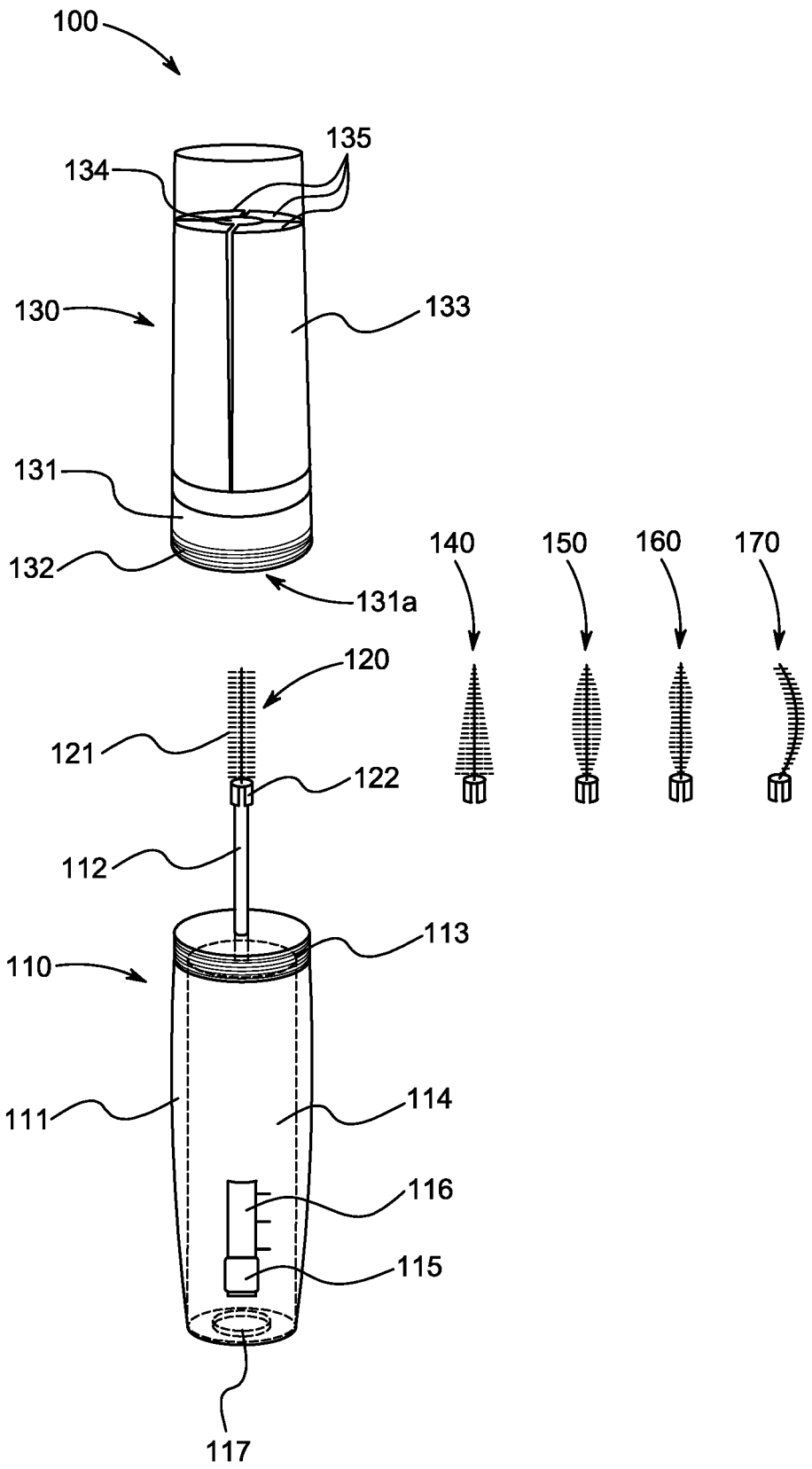
100
135
134
130
133
131
132
131a
140
150
160
170
120
121
122
112
113
110
111
114
116
115
117

VIBRATING MASCARA WAND WITH INTERCHANGEABLE MASCARA HEADS

BACKGROUND

1. Field

The present general inventive concept relates generally to a mascara wand, and particularly, to a vibrating mascara wand with interchangeable mascara heads.

2. Description of the Related Art

Conventional mascara wands allow a user to only have one type of a mascara brush with one shape for a particular makeup application.

If a user wants to have different eyelash effects, the user must purchase a new mascara brush having a different shape.

Also, conventional mascara brushes do not vibrate, which would allow for deeper penetrative makeup application.

Therefore, there is a need for a vibrating mascara wand with interchangeable mascara heads.

SUMMARY

The present general inventive concept provides a vibrating mascara wand with interchangeable mascara heads.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a vibrating mascara wand with interchangeable mascara heads, including a vibrating assembly to provide vibration for the vibrating mascara wand with interchangeable mascara heads, a first detachable mascara head connected to the vibrating assembly to receive the vibration from the vibrating assembly, and a cap assembly to detachably connect to the vibrating assembly and to store the first detachable mascara head therein.

The vibrating assembly may include a vibrating motor to provide the vibration, a vibrating assembly main body to store the vibrating motor therein, a mascara head attachment rod to receive the first detachable mascara head thereon, and a switch disposed on vibrating assembly main body and connected to the vibrating motor to power on and regulate a vibration intensity or vibration speed of the vibrating motor.

The first detachable mascara head may include a first detachable mascara head brush having a first shape to allow the user to apply makeup to eyelashes of the user to produce a first eyelash shape, and a mascara head attachment portion to attach to a tip of the mascara head attachment rod.

The cap assembly may include a cap assembly main body to detachably connect to the vibrating assembly main body, an opening disposed at a bottom portion of the cap assembly main body to allow at least a portion of the first detachable mascara head to be inserted into at least a portion of the cap assembly main body, and a detachable mascara head storage portion detachably disposed within the cap assembly main body, such that the detachable mascara head storage portion may include a center mascara head receiving compartment to receive at least a portion of the first detachable mascara head therein, and a plurality of auxiliary mascara head storage compartments disposed around the center mascara head receiving compartment.

The vibrating mascara wand with interchangeable mascara heads may further include a second detachable mascara head to detachably attach to the mascara head attachment rod, the second detachable mascara head comprising a second detachable mascara head brush having a second shape to allow the user to apply makeup to eyelashes of the user to produce a second eyelash shape, a third detachable mascara head to detachably attach to the mascara head attachment rod, the third detachable mascara head comprising a third detachable mascara head brush having a third shape to allow the user to apply makeup to eyelashes of the user to produce a third eyelash shape, a fourth detachable mascara head to detachably attach to the mascara head attachment rod, the fourth detachable mascara head comprising a fourth detachable mascara head brush having a fourth shape to allow the user to apply makeup to eyelashes of the user to produce a fourth eyelash shape, and a fifth detachable mascara head to detachably attach to the mascara head attachment rod, the fifth detachable mascara head comprising a fifth detachable mascara head brush having a fifth shape to allow the user to apply makeup to eyelashes of the user to produce a fifth eyelash shape.

Each of the plurality of auxiliary mascara head storage compartments may be configured to receive therein at least one of the second detachable mascara head, the third detachable mascara head, the fourth detachable mascara head, and the fifth detachable mascara head.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a front angled perspective view of a vibrating mascara wand with interchangeable mascara heads, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Vibrating Mascara Wand With Interchangeable Mascara Heads 100
Vibrating Assembly 110
Vibrating Assembly Main Body 111
Mascara Head Attachment Rod 112
Vibrating Assembly Main Body Threaded Portion 113
Vibrating Motor 114
Switch 115
Variable Speed Adjusting Slide 116
Battery Compartment 117
First Detachable Mascara Head 120
First Detachable Mascara Head Brush 121
Mascara Head Attachment Portion 122
Cap Assembly 130
Cap Assembly Main Body 131
Opening 131*a*
Cap Assembly Main Body Threaded Portion 132
Detachable Mascara Head Storage Portion 133
Center Mascara Head Receiving Compartment 134
Auxiliary Mascara Head Storage Compartments 135
Second Detachable Mascara Head 140
Third Detachable Mascara Head 150
Fourth Detachable Mascara Head 160
Fifth Detachable Mascara Head 170

FIG. 1 illustrates a front angled perspective view of a vibrating mascara wand with interchangeable mascara heads 100, according to an exemplary embodiment of the present general inventive concept.

The vibrating mascara wand with interchangeable mascara heads 100, and all components therein, may be constructed from at least one of metal, plastic, wood, silicone, liquid, fibers, threads, waxes, oils, and rubber, etc., but is not limited thereto, and can be constructed from any material known to one of ordinary skill in the art with regard to conventional mascara wands.

Also, the vibrating mascara wand with interchangeable mascara heads 100 may be constructed to be waterproof, such that water cannot penetrate inner components thereof, such as a battery, if the vibrating mascara wand with interchangeable mascara heads 100 is dropped in water.

The vibrating mascara wand with interchangeable mascara heads 100 may include a vibrating assembly 110, a first detachable mascara head 120, and a cap assembly 130, but is not limited thereto.

The vibrating assembly 110 may include a vibrating assembly main body 111, a mascara head attachment rod 112, a vibrating assembly main body threaded portion 113, a vibrating motor 114, a switch 115, a variable speed adjusting slide 116, and a battery compartment 117, but is not limited thereto.

The vibrating assembly main body 111 may include the vibrating motor 114 enclosed therein, such that the mascara head attachment rod 112 is attached to at least one of the vibrating assembly main body 111 and the vibrating motor 114.

The vibrating assembly main body 111 may also include the switch 115 a variable speed adjusting slide 116 disposed on a surface of the vibrating assembly main body 111, such that the switch 115 is also connected to the vibrating motor 114.

The battery compartment 117 may be disposed on and/or within the vibrating assembly main body 111 to allow a battery to be inserted therein, such that the battery is connectable to the vibrating motor 114 to provide power thereto.

Thus, when a user moves the switch 115 upward along the variable speed adjusting slide 116, the vibrating motor 114 may begin to vibrate. The higher the switch 115 is moved upward along the variable speed adjusting slide 116, the faster and/or more intensely the vibrating motor 114 vibrates.

The vibration of the vibrating motor 114 causes the vibration to be transferred to the first detachable mascara head 120, thus allowing the user to experience a more penetrative makeup application to eyelashes of the user.

The first detachable mascara head 120 may include a first detachable mascara head brush 121, and a mascara head attachment portion 122, but is not limited thereto.

Additionally, a USB port may be provided on the vibrating assembly main body 111 to allow the battery to recharge using a USB cable.

As illustrated in FIG. 1, the first detachable mascara head brush 121 has a straight shape.

The first detachable mascara head 120 may be attached to the mascara head attachment rod 112 via the mascara head attachment portion 122.

As illustrated in FIG. 1, the mascara head attachment portion 122 may have a tensioning-type attachment portion to allow the mascara head attachment portion 122 to snap onto the mascara head attachment rod 112.

Alternatively, the mascara head attachment rod 112 may have a threaded portion to correspond to a threaded portion of the mascara head attachment portion 122, to allow the mascara head attachment portion 122 to screw onto the mascara head attachment rod 112.

When the mascara head attachment portion 122 is attached to the mascara head attachment rod 112, the user can apply makeup onto the eyelashes of the user using the first detachable mascara head brush 121.

Also, as mentioned above, if the vibrating motor 114 is turned on, the vibrating motor 114 causes the vibration to be transferred to the first detachable mascara head 120 and the first detachable mascara head brush 121, thus allowing the user to experience a more penetrative makeup application to eyelashes of the user.

The cap assembly 130 may include a cap assembly main body 131, a cap assembly main body threaded portion 132, a detachable mascara head storage portion 133, a center mascara head receiving compartment 134, and a plurality of auxiliary mascara head storage compartments 135, but is not limited thereto.

The cap assembly main body threaded portion 132 may correspond to the vibrating assembly main body threaded portion 113, to allow the cap assembly 130 to be screwed onto the vibrating assembly 110. When the cap assembly 130 is screwed onto the vibrating assembly 110, a water-tight/waterproof seal may be formed.

The detachable mascara head storage portion 133 may be provided within the cap assembly main body 131.

The detachable mascara head storage portion 133 may include the center mascara head receiving compartment 134 to receive the first detachable mascara head 120 therein, and the plurality of auxiliary mascara head storage compartments 135 to store other mascara heads therein.

In detail, the cap assembly main body 131 may include an opening 131*a*, in-through which the first detachable mascara head 120 may be inserted to be further inserted through the center mascara head receiving compartment 134 of the detachable mascara head storage portion 133.

The center mascara head receiving compartment 134 may include makeup, oil, or wax stored therewithin, but is not limited thereto.

Also, the detachable mascara head storage portion 133 may be removed from the cap assembly main body 131 by pulling it through the opening 131*a*.

Additionally, other detachable mascara heads having brushes with different shapes and contours may be provided with the vibrating mascara wand with interchangeable mascara heads 100.

Referring to FIG. 1, a second detachable mascara head 140 having a brush with a tapered shape, a third detachable mascara head 150 having a convex shape, a fourth detachable mascara head 160 having a brush with an hourglass shape, and a fifth detachable mascara head 170 having a curved shape may be provided, but even more mascara heads having brushes with alternative shapes may also be provided, and thus, the present general inventive concept is not limited to the aforementioned brush shapes.

In other words, the first detachable mascara head 120 may be substituted by any one of the second detachable mascara head 140, the third detachable mascara head 150, the fourth detachable mascara head 160, and the fifth detachable mascara head 170.

Each of the second detachable mascara head 140, the third detachable mascara head 150, the fourth detachable mascara head 160, and the fifth detachable mascara head 170 may allow the user to form the user's eyelashes in different ways, corresponding to the shapes of each of the second detachable mascara head 140, the third detachable mascara head 150, the fourth detachable mascara head 160, and the fifth detachable mascara head 170, respectively.

Referring to FIG. 1, one the plurality of auxiliary mascara head storage compartments 135 of the detachable mascara head storage portion 133, illustrated herein as four separate auxiliary mascara head storage compartments 135, can each store one of the second detachable mascara head 140, the third detachable mascara head 150, the fourth detachable mascara head 160, and the fifth detachable mascara head 170, respectively.

The present general inventive concept may include a vibrating mascara wand with interchangeable mascara heads 100, including a vibrating assembly 110 to provide vibration for the vibrating mascara wand with interchangeable mascara heads 100, a first detachable mascara head 120 connected to the vibrating assembly 110 to receive the vibration from the vibrating assembly 110, and a cap assembly 130 to detachably connect to the vibrating assembly 110 and to store at least a portion of the first detachable mascara head 120 therein.

The vibrating assembly 110 may include a vibrating motor 114 to provide the vibration, a vibrating assembly main body 111 to store the vibrating motor 114 therein, a mascara head attachment rod 112 to receive the first detachable mascara head 120 thereon, and a switch 115 disposed on vibrating assembly main body 111 and connected to the vibrating motor 114 to power on and regulate a vibration intensity or vibration speed of the vibrating motor 114.

The first detachable mascara head 120 may include a first detachable mascara head brush 121 having a first shape to allow the user to apply makeup to eyelashes of the user to produce a first eyelash shape, and a mascara head attachment portion 122 to attach to a tip of the mascara head attachment rod 112.

The cap assembly 130 may include a cap assembly main body 131 to detachably connect to the vibrating assembly main body 111, an opening 131*a* disposed at a bottom portion of the cap assembly main body 131 to allow at least a portion of the first detachable mascara head 120 to be inserted into at least a portion of the cap assembly main body 131, and a detachable mascara head storage portion 133 detachably disposed within the cap assembly main body 131, such that the detachable mascara head storage portion 133 may include a center mascara head receiving compartment 134 to receive at least a portion of the first detachable mascara head 120 therein, and a plurality of auxiliary mascara head storage compartments 135 disposed around the center mascara head receiving compartment 134.

The vibrating mascara wand with interchangeable mascara heads may further include a second detachable mascara head 140 to detachably attach to the mascara head attachment rod 112, the second detachable mascara head 140 comprising a second detachable mascara head brush having a second shape to allow the user to apply makeup to eyelashes of the user to produce a second eyelash shape, a third detachable mascara head 150 to detachably attach to the mascara head attachment rod 112, the third detachable mascara head 150 comprising a third detachable mascara head brush having a third shape to allow the user to apply makeup to eyelashes of the user to produce a third eyelash shape, a fourth detachable mascara head 160 to detachably attach to the mascara head attachment rod 112, the fourth detachable mascara head 160 comprising a fourth detachable mascara head brush having a fourth shape to allow the user to apply makeup to eyelashes of the user to produce a fourth eyelash shape, and a fifth detachable mascara head 170 to detachably attach to the mascara head attachment rod 112, the fifth detachable mascara head 170 comprising a fifth detachable mascara head brush having a fifth shape to allow the user to apply makeup to eyelashes of the user to produce a fifth eyelash shape.

Each of the plurality of auxiliary mascara head storage compartments 135 may be configured to receive therein at least one of the second detachable mascara head 140, the third detachable mascara head 150, the fourth detachable mascara head 160, and the fifth detachable mascara head 170.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A vibrating mascara wand with interchangeable mascara heads, comprising:

a vibrating assembly to provide vibration for the vibrating mascara wand with the interchangeable mascara heads;

a first detachable mascara head connected to the vibrating assembly to receive the vibration from the vibrating assembly; and a cap assembly to detachably connect to the vibrating assembly and to store at least a portion of the first detachable mascara head therein, wherein:

the vibrating assembly comprises:

a vibrating motor to provide the vibration, a vibrating assembly main body to store the vibrating motor therein, a mascara head attachment rod to receive the first detachable mascara head thereon, and a switch disposed on vibrating assembly main body and connected to the vibrating motor to power on and regulate a vibration intensity or vibration speed of the vibrating motor;

the first detachable mascara head comprises:

a first detachable mascara head brush having a first shape to allow the user to apply makeup to eyelashes of the user to produce a first eyelash shape, and a mascara head attachment portion to attach to a tip of the mascara head attachment rod; and the cap assembly comprises:

a cap assembly main body to detachably connect to the vibrating assembly main body, an opening disposed at a bottom portion of the cap assembly main body to allow at least a portion of the first detachable mascara head to be inserted into at least a portion of the cap assembly main body, and a detachable mascara head storage portion detachably disposed within the cap assembly main body, the detachable mascara head storage portion comprising:

a center mascara head receiving compartment to receive at least a portion of the first detachable mascara head therein, and a plurality of auxiliary mascara head storage compartments disposed around the center mascara head receiving compartment.

2. The vibrating mascara wand with the interchangeable mascara heads of claim 1, further comprising:

a second detachable mascara head to detachably attach to the mascara head attachment rod, the second detachable mascara head comprising a second detachable mascara head brush having a second shape to allow the user to apply makeup to eyelashes of the user to produce a second eyelash shape;

a third detachable mascara head to detachably attach to the mascara head attachment rod, the third detachable mascara head comprising a third detachable mascara head brush having a third shape to allow the user to apply makeup to eyelashes of the user to produce a third eyelash shape;

a fourth detachable mascara head to detachably attach to the mascara head attachment rod, the fourth detachable mascara head comprising a fourth detachable mascara head brush having a fourth shape to allow the user to apply makeup to eyelashes of the user to produce a fourth eyelash shape; and a fifth detachable mascara head to detachably attach to the mascara head attachment rod, the fifth detachable mascara head comprising a fifth detachable mascara head brush having a fifth shape to allow the user to apply makeup to eyelashes of the user to produce a fifth eyelash shape.

3. The vibrating mascara wand with the interchangeable mascara heads of claim 2, wherein each of the plurality of auxiliary mascara head storage compartments is configured to receive therein at least one of the second detachable mascara head, the third detachable mascara head, the fourth detachable mascara head, and the fifth detachable mascara head.

* * * * *